United States Patent [19]

Durr

[11] 4,101,856

[45] Jul. 18, 1978

[54] ELECTRICAL SWITCHING RELAY CONSTRUCTION AND HOUSING THEREFOR

[75] Inventor: Ernst Durr, Ebhausen, Fed. Rep. of Germany

[73] Assignee: Fritz Kolle, Fed. Rep. of Germany

[21] Appl. No.: 782,704

[22] Filed: Mar. 30, 1977

[30] Foreign Application Priority Data

Apr. 7, 1976 [DE] Fed. Rep. of Germany ..... 2614942

[51] Int. Cl.[2] ..... H01H 50/04

[52] U.S. Cl. ..... 335/135; 335/202

[58] Field of Search ..... 335/135, 202, 132, 201, 335/203, 133, 128

[56] References Cited

U.S. PATENT DOCUMENTS

| | | | |
|---|---|---|---|
| 3,560,901 | 2/1971 | Horii et al. | 335/132 |
| 3,671,891 | 6/1972 | Shiojima et al. | 335/132 |
| 3,750,060 | 7/1973 | Pfenning | 335/135 |
| 3,800,252 | 3/1974 | Aigner | 335/135 |
| 3,801,940 | 4/1974 | Grassl | 335/135 |
| 3,824,511 | 7/1974 | Aidn et al. | 335/202 |

*Primary Examiner*—Harold Broome

*Attorney, Agent, or Firm*—McGlew and Tuttle

[57] ABSTRACT

A housing for a small size electronic switching relay comprises an integral single part housing skeletal structure of insulating material which has an interior space which is divided by first and second partition walls which extend perpendicularly to each other into an armature chamber and first and second spring contact chambers. The housing includes a first and second set of spring contact holder slots defined therein which extend from the exterior of the housing into the respective first and second spring contact chambers. The first partition wall separates the armature chamber from the spring contact chambers and it has an actuator guide slot defined therein which extends from the armature chamber into respective ones of the first and second spring contact chambers. The housing has a wall bounding an end of the armature chamber with an armature biasing spring retainer slot. An armature coil is positioned in the armature chamber and an angle-shaped armature has one end which is attracted by the armature yoke within the coil and an opposite end which engages against an actuating member which extends through the first partition wall and to respective ones of the first and second spring contact chambers and moves one of the spring contacts toward or away from respective other ones of spring contacts which are held in the slots defined at the respective ends of the two spring contact chambers.

7 Claims, 6 Drawing Figures

ELECTRICAL SWITCHING RELAY CONSTRUCTION AND HOUSING THEREFOR

FIELD AND BACKGROUND OF THE INVENTION

This invention relates in general to the construction of switches and housings therefor and, in particular, to a new and useful skeletal housing construction of insulating material which provides means for separating and mounting various components of a magnetic system and switch contact elements within three separate chambers.

DESCRIPTION OF THE PRIOR ART

The present invention relates particularly to a small electromagnetic switching relay comprising an insulating skeletal structure which is formed with three compartments separated from each other and which serves as a support for accommodating the magnet system and at least two contact systems.

Since small switching relays are employed on an ever increasing scale in household and similar appliances, there are increasing problems with respect to the insulation resistance, the testing equipment connected thereto, and the relays used therein in respect to the regulations of various testing boards which regulate the requirements for such devices.

Electromagnetic relays are known in which the magnet and contact systems are accommodated in a common basic body, and to increase the electrical strength, are insulated from each other by a partition wall. As is well known, the problem of insulating the systems from each other is frequently also solved by interposing loose insulating parts between the conductive parts. The insulation of the systems relative to each other becomes critical, however, if the relay is equipped with more than one contact system. In such cases, constructions are known in which the insulating support of the contact bank is manufactured in one piece and serves only to receive the contact springs which are insulated from each other by a separating wall extending therebetween. Since this contact bank must be secured to the yoke of the magnet system, the insulation resistance between the magnet system and the contact springs is substantially reduced.

SUMMARY OF THE INVENTION

The present invention is directed to a single-piece insulating basic structure of a design such that the magnet system and at least two contact systems of the relay are electrically separated from each other and can be assembled in a simple and economical manner, and that the individual systems withstand, with respect to each other, a relatively high testing voltage, without the occurrence of a flashover. In accordance with the invention, this is obtained by providing an insulating skeletal structure having three individual compartments which are formed by two partition walls extending perpendicularly to each other.

The inventive partition wall between the magnet system and the contact systems is provided with a slot-shaped opening intended for receiving and guiding the actuating member of the contact springs. Two pins are provided on each side of the partition wall separating the contact systems to improve the guidance of this actuating member.

A further simplification and also an economical mounting of the retaining spring which, at the same time, acts as a return spring for the hinged armature of the magnet system, is obtained by providing a slot on the outer wall opposite to the hinged armature of the insulating skeletal structure. The slot extends obliquely inwardly and receives the retaining spring of the armature which is preferably designed as a T-shaped leaf spring. The angle of inclination of the slot is chosen so that the desired retaining or returning force for the hinged armature is obtained without buckling the retaining spring.

An object of the invention is to provide a housing for a small size switching relay which is made of a single piece of insulating material, such as a molded plastic, and which includes partition walls which divide the housing into two spring contact member chambers which have wall means which provide an end mounting for the spring contacts and the terminals therefor, and an armature chamber which contains an armature which is actuated by a coil therein and a partition wall between the armature chamber and the two spring contact chambers which defines means for guiding an actuating member movable by the armature and also includes an end wall in the armature chamber which provides means for mounting a biasing spring for the armature.

A further object of the invention is to provide a housing and switch construction in which the housing includes a skeletal formation forming a support and guidance for the biasing of the armature, the guidance of an actuating member and the mounting of the spring contacts in their terminals.

Another object of the invention is to provide an electrical switching relay and a housing therefor which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

FIG. **4*a*** is a side elevational view of one side of the housing; and

FIG. **4*b*** is a side elevational view of the opposite side of the housing.

DESCRIPTION OF THE PREFERRED EMBODIMENT

Figure 1:
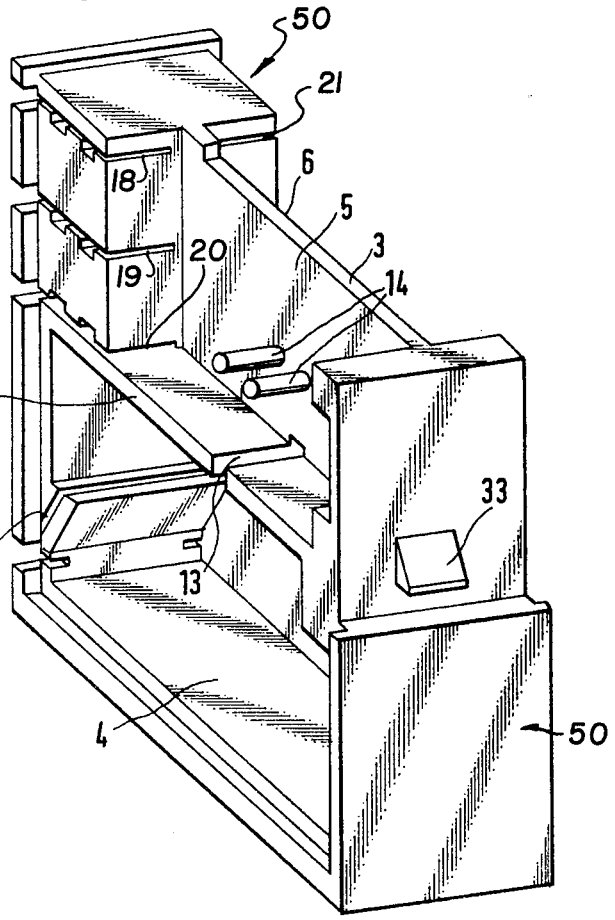
FIG. 1 is an end top perspective view of a switch housing constructed in accordance with the invention.
Figure 3:
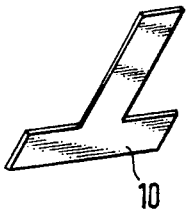
FIG. 3 is a perspective view of an armature biasing spring for the relay.

Referring to the drawings in particular, the invention embodied in FIG. 1, comprises a one-piece electronic switching relay housing or skeletal structure made of insulating material and generally designated 50. The skeletal structure 50 includes a first partition wall 2 which divides an interior space within the housing into an armature chamber or compartment 4 and spring contact chambers which are further divided by a second partition wall 3 into respective first and second spring contact chambers 5 and 6. Each housing chamber 5 and 6 is provided with a block-shape structure adjacent one end which defines a set of spring contact holder slots 18, 19 and 20 in the spring contact chamber 5 and 21, 22 and 23 in the spring contact chamber 6.

Figure 4B:
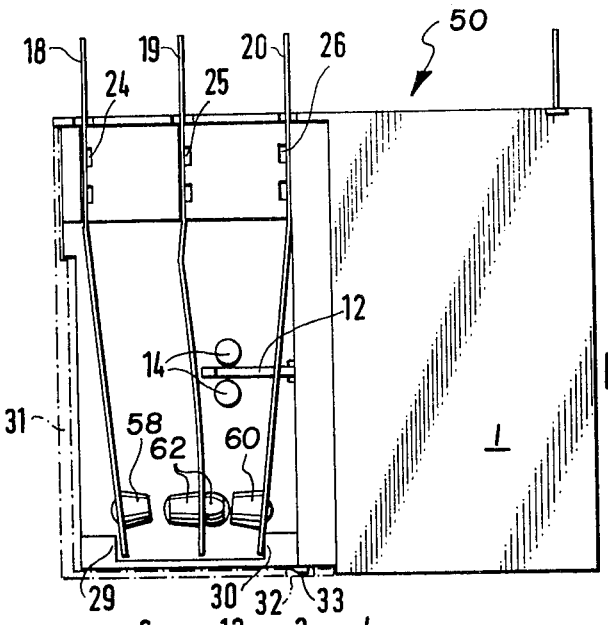
FIG. 4 is a transverse sectional view through the housing of FIG. 1 with the relay parts positioned therein.
Figure 4:
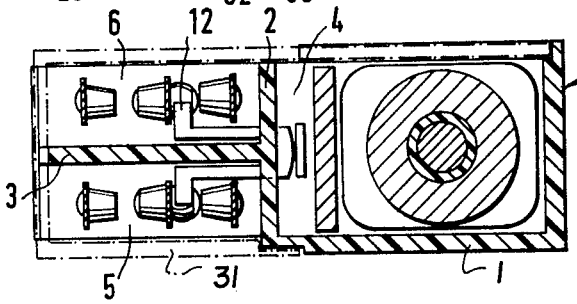
Figure 4A:
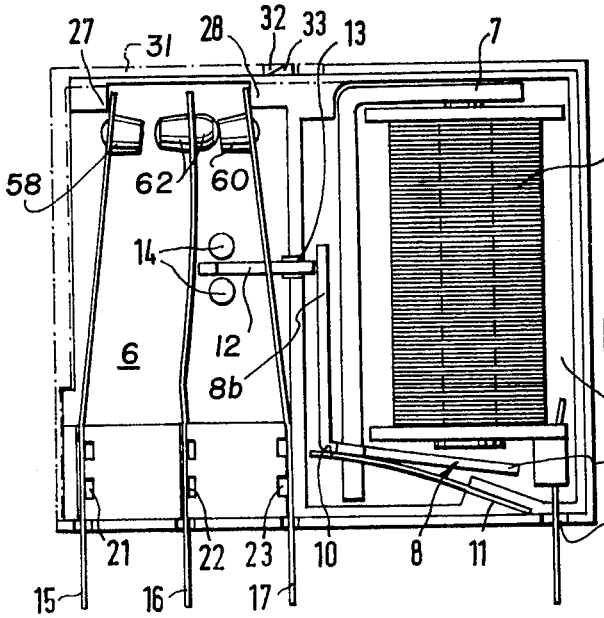

The skeletal structure 50 includes an actuator member guide means which comprises a slot defined in the partition 2 and spaced apart pins 14 which are made to extend to each side of the partition wall 3, into the respective spring contact chambers 5 and 6. In addition, the armature chamber is provided with an armature biasing spring retainer slot 13. The housing is closed to the exterior by a plastic transparent hood 31 shown in FIGS. 4, 4*a* and 4*b*. The hood 31 is provided with a square aperture 32 which, upon putting the hood in place, snaps behind a locking nose 33 which is defined on the exterior wall of the housing 50, whereby, the hood 31 is retained. In the embodiment illustrated, the armature chamber 4 is closed by a wall portion 1 which extends on one side only. The opposite side is covered by a transparent hood 31.

The inventive electronic switching relay construction includes a wound coil 9 disposed around a magnetic yoke 7 in the armature compartment 4. An angle-shaped armature has a first arm portion 8*a* which is disposed opposite one end of yoke 7 for attraction thereby during the actuation and energizing of coil 9. The connection for the coil extends through a slot 52 of the housing.

Figure 2:
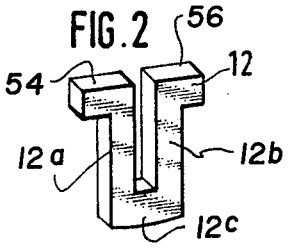
FIG. 2 is a front top perspective view of an actuating member used with a switching relay which is engageable in the housing.

In accordance with a feature of the invention, armature 8 is biased by a spring 10 which is positioned in a spring retaining slot 11 defined in the housing skeletal structure. The armature 8 includes a second arm portion 8*b* which is disposed along the length of the coil 9 for engagement with an actuator member 12, indicated in FIG. 2, which is inserted such that leg portions 12*a* and 12*b* extend from a web portion 12*c* in the armature compartment 4 into respective spring contact compartments 5 and 6. The leg portions are also guided between pins 14 and they include end flanges 54 and 56 which are disposed for moving, for example, one spring contact 16 or 19 of each respective first and second sets of spring contacts 18, 19 and 20 disposed in the spring contact chamber 5, and 15, 16 and 17 disposed in the chamber 6. The respective spring contacts are mounted in slots 21, 22 and 23 of the chamber 6 and 24, 25 and 26 of the chamber 5. The two outer spring contacts 18 and 20 and 15 and 17 carry respective oppositely extending contact buttons 58 and 60 and the inner contact springs 19 and 16 of each set carry double contact buttons 62 which extend in each direction. In the construction indicated, middle contacts 19 and 16 are moved by the actuating member 12.

The retaining spring 10 as mounted in its associated slot applies a returning force to armature 8. When actuated by the energization of coil 9, the armature moves to move the actuating member 12.

While a specific embodiment of the invention has been shown and described in detail to illustrate the application of the principles of the invention, it will be understood that the invention may be embodied otherwise without departing from such principles.

What is claimed is:

1. An electronic switching relay housing, comprising an integral single part housing skeletal structure of insulating material having an interior space, first and second partition walls disposed substantially perpendicular to each other within said housing and dividing the interior of said housing into an armature chamber and first and second spring contact chambers, said housing including a first and second set of spring contact holder slots defined therein extending from the exterior of said housing into respective ones of first and second spring contact chambers, said first partition wall separating said armature chamber from said first and second spring contact chambers and having an actuator guide slot defined therethrough extending from said armature chamber into respective first and second spring contact chambers, said housing having a wall bounding an end of said armature chamber with an armature biasing spring retainer slot defined therein.

2. An electronic switching relay housing, according to claim 1, wherein said housing includes a shoulder formation on each side of respective first and second spring contact chambers forming spring contact limit surfaces for fixing end positions of respective spring contacts.

3. An electronic switching relay housing, according to claim 1, including first and second spaced apart pin projections defined in each of said first and second spring contact chambers defining a guide space therebetween aligned with the actuator guide slot defined in said first partition wall.

4. An electronic switching relay housing, according to claim 1, including an armature disposed in said armature chamber, coil means for energizing said armature, an armature biasing spring disposed in said biasing spring retainer slot and biased against said armature to move it to a return position, an actuator member extending into said actuator guide slot and into respective ones of said first and second spring contact chambers, a set of spring contacts mounted in each of said spring contact chambers including terminal end portions which extend through the contact holder slots, at least one of said spring contacts of said spring contact sets being movable by said actuating member.

5. An electronic switching relay, comprising an integral single-part housing skeletal structure of insulating material having an interior space, first and second partition walls disposed substantially perpendicular to each other in said housing and dividing the interior of said housing into an armature chamber and first and second spring contact chambers, said housing including first and second sets of spring holder slots defined therein extending from the exterior of said housing into respective ones of said first and second spring contact chambers, respective spring contacts positioned in respective ones of said contact holder slots having exterior portions forming terminals extending to the exterior of said housing and having interior portions with contacts thereon, at least one of said spring contacts being movable relative to the others in order to position it into contact engagement or release from contact engagement therewith, said first partition wall separating said armature chamber from said first and second spring contact chambers having an actuator guide slot defined therethrough extending from said armature chamber to respective ones of said first and second spring contact chambers, an actuator extending through said actuator guide slot, an armature disposed in said armature chamber and engageable with said actuator, electric coil means associated with said armature for moving said armature to move said actuator, said housing having a wall bounding an end of said armature chamber with an armature biasing spring retainer slot, and a retainer spring disposed in said armature biasing spring retainer slot and biased against said armature to move it to a return position.

6. An electronic switching relay, according to claim 5, wherein each set of spring contacts includes an intermediate spring contact and an end spring contact on each side of said intermediate spring contact, said actuating member being movable to move said intermediate contact toward and away from engagement with respective ones on each side thereof, said armature comprising an angle member having one portion engageable with said actuator and an opposite portion movable by said coil means.

7. An electronic switching relay, according to claim 6, including a shoulder defined in each of said spring contact chambers on each side of the spring contact on each side of the intermediate spring contacts and forming supporting rests against which the exterior spring contacts abut under tension and which defines the desired contact clearance between the intermediate spring contact and ones on each side thereof.

* * * * *